US010094011B2

(12) United States Patent
Zhong et al.

(10) Patent No.: US 10,094,011 B2
(45) Date of Patent: Oct. 9, 2018

(54) SUPERSTRENGTH COLD-ROLLED WEATHERING STEEL SHEET AND METHOD OF MANUFACTURING SAME

(71) Applicant: BAOSHAN IRON & STEEL CO., LTD., Shanghai (CN)

(72) Inventors: Yong Zhong, Shanghai (CN); Li Wang, Shanghai (CN); Weijun Feng, Shanghai (CN); Xiaoming He, Shanghai (CN); Junjie Huang, Shanghai (CN); Yanglin Ke, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 247 days.

(21) Appl. No.: 14/777,249

(22) PCT Filed: Mar. 26, 2014

(86) PCT No.: PCT/CN2014/074091

§ 371 (c)(1),
(2) Date: Sep. 15, 2015

(87) PCT Pub. No.: WO2014/187193

PCT Pub. Date: Nov. 27, 2014

(65) Prior Publication Data

US 2016/0160330 A1 Jun. 9, 2016

(30) Foreign Application Priority Data

May 22, 2013 (CN) ..... 2013 1 0190897

(51) Int. Cl.

| | |
|---|---|
| ***C22C 38/20*** | (2006.01) |
| ***C22C 38/28*** | (2006.01) |
| ***C22C 38/38*** | (2006.01) |
| ***C21D 1/613*** | (2006.01) |
| ***C21D 1/00*** | (2006.01) |
| ***C21D 9/46*** | (2006.01) |
| ***C21D 8/02*** | (2006.01) |
| ***C22C 38/58*** | (2006.01) |
| ***C22C 38/00*** | (2006.01) |
| ***C22C 38/04*** | (2006.01) |
| ***C22C 38/06*** | (2006.01) |
| ***C22C 38/42*** | (2006.01) |
| ***C22C 38/50*** | (2006.01) |
| ***B22D 11/00*** | (2006.01) |
| ***C21D 1/26*** | (2006.01) |
| ***C21D 6/00*** | (2006.01) |

(52) U.S. Cl.

CPC ..... *C22C 38/58* (2013.01); *B22D 11/00* (2013.01); *C21D 1/26* (2013.01); *C21D 1/613* (2013.01); *C21D 6/004* (2013.01); *C21D 6/005* (2013.01); *C21D 8/021* (2013.01); *C21D 8/0205* (2013.01); *C21D 8/0226* (2013.01); *C21D 8/0236* (2013.01); *C21D 9/46* (2013.01); *C22C 38/002* (2013.01); *C22C 38/04* (2013.01); *C22C 38/06* (2013.01); *C22C 38/20* (2013.01); *C22C 38/28* (2013.01); *C22C 38/38* (2013.01); *C22C 38/42* (2013.01); *C22C 38/50* (2013.01); *C21D 8/0273* (2013.01)

(58) Field of Classification Search
None
See application file for complete search history.

(56) References Cited

U.S. PATENT DOCUMENTS

2010/0092331 A1 4/2010 Jeong et al.

FOREIGN PATENT DOCUMENTS

| | | | | |
|---|---|---|---|---|
| CN | 101376950 A | | 3/2009 | |
| CN | 101994065 A | | 3/2011 | |
| CN | 103266274 A | | 8/2013 | |
| JP | 51126322 | * | 11/1976 | ..... C22C 38/00 |
| JP | 2002161336 A | | 6/2002 | |
| WO | WO 2008/072866 | * | 6/2008 | |
| WO | 2012072884 A1 | | 6/2012 | |

OTHER PUBLICATIONS

Machine-English translation of Japanese patent No. 2001-247935 to Yamamoto Sadahiro et al., Sep. 14, 2001.*
Machine-English translation of JP 51126322, Haegawa et al., Nov. 4, 1976.*
PCT International Search Report, PCT/CN2014/074091, dated Jun. 25, 2014, 4 pages.

* cited by examiner

*Primary Examiner* — Deborah Yee
(74) *Attorney, Agent, or Firm* — Quarles & Brady LLP

(57) ABSTRACT

The present invention discloses a superstrength cold rolled weathering steel sheet, wherein the weight percentage of the chemical elements thereof are as follows: C: 0.05~0.16%; Mn: 1.00~2.20%; Al: 0.02~0.06%; Cu: 0.20~0.40%; Cr: 0.40~0.60%; Ti: 0.015~0.035%; P: less than 0.03%; and C+Mn/16 is more than 0.19% and less than 0.23%; the remainders thereof being Fe and other unavoidable impurities. The present invention also discloses a method of manufacturing said superstrength cold rolled weathering steel sheet, comprising the following stages: smelting, heating and preservation, hot rolling, coiling, pickling, cold rolling, continuous annealing and skin passing. The advantages of the superstrength cold rolled weathering steel sheet and the method of manufacturing the same are: high strength, i.e., the yield strength more than 700 MPa and the tensile strength more than 1000 MPa; excellent performance of atmosphere corrosion resistance; thin so as to meet the demand of reducing the thickness and weight thereof; good shape and surface quality.

13 Claims, No Drawings

SUPERSTRENGTH COLD-ROLLED WEATHERING STEEL SHEET AND METHOD OF MANUFACTURING SAME

CROSS-REFERENCE TO RELATED APPLICATIONS

This application represents the national stage entry of PCT International Application No. PCT/CN2014/074091 filed Mar. 26, 2014, which claims priority of Chinese Patent Application No. 201310190897.4 filed May 22, 2013, the disclosures of which are incorporated by reference here in their entirety for all purposes.

TECHNICAL FIELD

The present invention relates to an alloy steel sheet, and a method of manufacturing the same, and in particular, to a weathering alloy steel sheet and a method of manufacturing the same.

BACKGROUND

Currently, it is a major tendency of the development of steel and iron materials, to adopt thin steel sheet of higher strength to make steel structures thinner and lighter. At the same time, those hot rolled or cold rolled weathering steel sheets which are widely applied in transportation industries, evolve in the direction of higher strength and lower alloy content, so as to meet the demands of the terminal customers on weight reduction, energy conservation, lower cost. Since 1930s when United States Steel Corporation first developed low-alloy Corten steel containing Cu with erosion resistance and high tensile strength, a series of Corten A steel with high content of P and Cu plus Cr, Ni, and a series of Corten B steel with alloying Cr, Mn, Cu, had been formed. Subsequently, a series of weathering steels treated by rare earth were developed in China. With respect to improving the strength of the weathering steel, the major measures are solid solution strengthening, precipitation strengthening, transformation strengthening, etc., wherein the latter two strengthening methods are mainly employed to improve the strength of weathering steel of super strength.

China patent of Publication No. CN1884608A, published on Dec. 27, 2006 and titled "method of producing 700 MPa level V-N micro-alloying high-strength atmosphere corrosion resistant steel based on continuous casting and rolling process of thin slab", discloses a method of producing high-strength atmosphere corrosion resistant steel. Depending on the characteristics of continuous casting and rolling process and metallurgical compositions of thin slab, the method adopts processes of electric furnace or converter smelting, refining, thin slab continuous casting, entering the roller hearth heating or soaking furnace directly after casting blanks solidify, hot rolling, laminar cooling and coiling, wherein, the ranges (wt %) of chemical compositions of the molten steel are: C: less than or equal to 0.08%; Si: 0.25~0.75%; Mn: 0.8~2.0%; P: 0.070~0.150%; S: less than or equal to 0.040%; Cu: 0.25~0.60%; Cr: 0.30~1.25 wt %; Ni: less than or equal to 0.65%; V: 0.05~0.20%; N: 0.015~0.030%.

US patent of Publication No. U.S. Pat. No. 6,056,833, published on May 2, 2000 and titled "thermomechanically controlled processed high strength weathering steel with low yield/tensile ratio" relates to a weathering steel sheet with a low yield/tensile ratio that has a minimum yield strength of 70-75 ksi and a yield/tensile ratio less than or equal to about 0.85. The chemical compositions of the weathering steel sheet consists (wt %) of C: 0.08~0.12%; Mn: 0.80~1.35%; Si: 0.30~0.65%; Mo: 0.08~0.35%; V: 0.06~0.14%; Cu: 0.20~0.40%; Ni: 0.50%; Cr: 0.30~0.70%; P: 0.010~0.020%; Nb: less than or equal to 0.04%; Ti: less than or equal to 0.02%; S: less than or equal to 0.01%; the remainders thereof being Fe and other unavoidable impurities.

Korean patent of Publication No. KR431839, published on May 20, 2004, and titled "method of producing cold rolled weathering steel sheet", discloses a method of producing the cold rolled atmosphere corrosion resistant steel sheet, wherein, the chemical compositions of the steel sheet consist of C: 0.06~0.08 wt %; Si: 0.17~0.24 wt %; Mn: 0.9~1.10 wt %; P: less than or equal to 0.020 wt %; S: less than or equal to 0.010 wt %; Cu: 0.20~0.30 wt %; Ni: 0.20~0.30 wt %; H: less than or equal to 2.5 ppm, the remainders thereof being Fe and other unavoidable impurities. The steel sheet has a tensile strength of more than or equal to 45 kgf/mm$^2$, a yield strength of more than or equal to 32 kgf/mm$^2$, and an elongation rate of more than or equal to 22%.

The aforementioned first and second patents use hot rolling processes to produce the weathering steel sheet, and due to the limitation with respect to the thickness of steel sheet in hot rolling units, the weathering steel sheet produced in hot rolling process has often a large thickness, and further, the limit thickness of available the hot rolling steel sheet increases with the improvement of the strength thereof. Besides, the shape and surface quality of the hot rolling steel sheet is still poor than that of cold rolling steel sheet. Although the above third patent adopts cold rolling process to produce the weathering steel, the steel sheet presents a low strength (the yield strength is only 300 MPa), which cannot be widely used in the production of high strength steel structures.

SUMMARY

One of the objectives of the present invention is to provide a superstrength cold rolled weathering steel sheet, that has a large strength, a small thickness, excellent resistance to atmosphere corrosion resistant, good shape and surface quality, so as to accommodate with the tendency of thinner and lighter steel structures; additionally, it does not contain the element Si, thereby improving the manufacturability of the materials, nor the element Nb, thereby reducing the production cost.

To achieve the aforementioned objectives, the present invention proposes a superstrength cold rolled weathering steel sheet, the weight percentage of the chemical elements of which are as follows:

C: 0.05~0.16%;
Mn: 1.00~2.20%;
Al: 0.02~0.06%;
Cu: 0.20~0.40%;
Cr: 0.40~0.60%;
Ti: 0.015~0.035%;
P: less than or equal to 0.03%;

the remainders thereof being Fe and other unavoidable impurities. The unavoidable impurities in this technical solution consist primarily of elements S and N; and further includes unavoidable residual trace element Si.

Preferably, the weight percentage of the chemical elements of the superstrength cold rolled weathering steel sheet are further defined as follows:

C: 0.07~0.15%;
Mn: 1.30~2.00%;

Al: 0.02~0.04%;

Cu: 0.25~0.35%;

P: less than or equal to 0.15%.

The preferable composition ratio above can make the technical solution more beneficial in practice.

Preferably, the above-mentioned superstrength cold rolled weathering steel sheet further includes Ni of less than 0.20 wt %, and a suitable amount of Ni is added to further improve the weathering performance of the steel sheet.

Furthermore, the microstructure of the above-mentioned superstrength cold rolled weathering steel sheet is martensite, the volume fraction of which is more than 95%.

Furthermore, the thickness of the above-mentioned superstrength cold rolled weathering steel sheet is 0.8~1.5 mm.

The design principle of the chemical elements of the superstrength cold rolled weathering steel sheet as mentioned in this invention is as follows:

C: C is the most fundamental strengthening element in steel, able to improve the hardenability and strength effectively. The present invention relates to a weathering steel subjected to high hydrogen cooling, which has a maximum cooling speed of 150° C./s. The content of C has to be more than 0.05% in order to achieve martensite phase transformation. But if it is more than 0.16%, the welding performance of the steel may not meet the demand in use. In light of this and taking the strength and operational performance of the material into account, the content of C in the present invention is controlled in the range of 0.05~0.16 wt %. Preferably, the range thereof is 0.07~0.15 wt %.

Mn: Mn is a solid solution strengthening element, benefitting for improve the strength of the steel sheet. To obtain the steel in the present invention that has a yield strength of more than or equal to 700 MPa, and a tensile strength of more than or equal to 1000 MPa, the content of Mn has to be more than 1.0%. But excessive Mn may result in the reduction of the welding performance and inadequacy of the elongation rate. To meet the demand that the elongation rate is more than or equal to 5%, the content of Mn should be less than equal to 2.2%. In sum, the content of Mn in the present invention is designed to be 1.00~2.20 wt %, and further, 1.30~2.00 wt %. Both C and Mn have the effect of improving the strength of the material and reducing the welding performance thereof, hence, the content of them cannot be the maximum or minimum value in the present invention. In order to meet the above requirements, the relationship between the compositions C and Mn is designed to be: $0.19\% < C + Mn/16 < 0.23\%$ in this invention.

Al: the addition of Al aims for deoxidization. The steel in the present invention is required to be of good cold bending property, but excessive content of O may result in the degradation of the formation performances of the material, like cold bending. In order to satisfy the demand on the formation performances of the steel, the content of Al should not be less than 0.02%. However, excessive Al may result in too many impurities such as AlN in the steel sheet, reducing the elongation rate of the material. In light of this, taking both the deoxidization impurities into account, the content of carbon should be controlled in 0.02~0.06%, and preferably, 0.0~0.04%.

Cu: Cu involves in forming a barrier with the primary components Cu and P between the base strip and the rust layer, which bonds tightly with the base strip to protect the same well. Furthermore, Cu can also compensate the impairment of impurity element S in the steel sheet. In order to ensure the weathering performance required by the steel sheet in the present invention, the content of Cu should not be less than 0.2%. But the addition of excessive Cu may cause serious problem such as "Cu brittleness". The maximum amount of Cu should be 0.4%, in such a way to coordinate with the addition of the element Ni. Accordingly, in the present invention, the content of Cu in the superstrength cold rolled weathering steel sheet should be set in 0.20~0.40 wt %, and in the preferred solution, the content may be set in 0.25~0.35%.

Cr: Cr involves in forming an dense oxidized film on the surfaces of the steel sheet, so as to improve the ability of deactivation of the steel sheet, and especially when Cr and Cu are added into steel simultaneously, the effect is more obvious; in the present technical solution, it is needed that the weight percentage of Cr should be controlled in 0.40~0.60%.

Ti: Ti is the main element for the formation of carbonitride, which can improve the formation performance of the steel sheet through precipitation strengthening and fine crystal strengthening. Accordingly, the weight percentage of Ti in the present invention should be designed to be in 0.015~0.035%.

P: specifically speaking, although P is the impurity element in most steels, P together with Cu in the present invention may form a barrier for resisting erosion, thereby improving the performance of the atmosphere corrosion resistance of the steel sheet; at the same time, it has an effect of solid solution strengthening. However, excessive P may increase the brittleness of the steel and degrade the welding performance thereof, whereby the weight percentage of P should be controlled to be less than or equal to 0.030% and preferably less than or equal to 0.015%.

Ni: the addition of Ni aims for alleviating the problem of "Cu brittleness" caused by the addition of Cu. In order to obtain good effect and reduce the cost, the ratio of Cu and Ni should be less than or equal to ⅔. Based on this, the content of Ni in the present invention is designed to be less than or equal to 0.2%.

The present invention further provides a container panel manufactured with the aforementioned superstrength cold rolled weathering steel sheet. This container panel has a good shape and superior surface quality.

The present invention further provides a vehicle structure panel manufactured with the aforementioned superstrength cold rolled weathering steel sheet. This vehicle structure panel has a light weight and a high strength.

Correspondingly, the present invention further provides a method of manufacturing the aforementioned superstrength cold rolled weathering steel sheet, comprising the following stages: smelting, heating and preservation, hot rolling, coiling, pickling, cold rolling, continuous annealing, skin passing; wherein, in the continuous annealing process, the annealing temperature is 830~880° C. so as to enable the complete austenization, then the steel is cooled rapidly in an high hydrogen atmosphere so as to attain martensite structure.

In the manufacturing process, the present invention adopts the continuous annealing process and the annealing temperature higher than that in the prior art, so as to ensure the austenization before the steel sheet is cooled rapidly. The temperature can be controlled by adjusting the extent of austenization, in order to modulate the mechanical and forming properties of the finished products. In the process of rapid cooling, the high hydrogen atmosphere is utilized for rapid cooling, to obtain martensite micro-structure therein; comparing to the water quenching process, the cooling effect in rapid cooling process in the high hydrogen atmosphere is more even, thereby not only reducing the production cost of steel, but also obtaining more excellent shape and surface quality.

Furthermore, in the stage of continuous annealing process above, the volume fraction of hydrogen in the high hydrogen atmosphere is 60%.

Furthermore, in the stage of continuous annealing process above, the cooling speed of the rapid cooling is more than 100° C./s.

Preferably, in the continuous annealing process above, the annealing temperature is further defined as 850~880° C., in order to achieve better effect.

Furthermore, in the stages of heating and preservation above, the slab is heated and preserved at 1170~1200° C. The technical solution adopts low heating and preserving temperatures, in order to reduce the adverse effect by Cu on the thermoplastic performance of the steel, under the premise of ensuring the complete soluting of the C, N compound.

Furthermore, in the stage of hot rolling above, the finish rolling temperature is more than or equal to Ar3.

Furthermore, in the stage of coiling above, the coiling temperature is 450~550° C. The technical solution adopts a low coiling temperature which is good for alleviating the problem of squashing after the steel coil is uncoiled, while fine precipitated phase can be obtained in the steel sheet.

Furthermore, in the stage of cold rolling above, the reduction rate therein is 50~60%.

The superstrength cold rolled weathering steel sheet in the invention, with the reasonable composition design and suitable technological processes, presents superior effect in practice: it presents excellent performance of atmosphere corrosion resistance; high strength, i.e., the yield strength more than 700 MPa and the tensile strength more than 1000 MPa; good shape and surface quality.

DETAILED DESCRIPTION

Hereinafter, a detailed description will be given in conjunction with the detailed embodiments, to further specify the superstrength cold rolled weathering steel sheet and the method thereof in the present invention, which, however, do not constitute the improper limitation on the present technical solution.

Embodiments 1~7

The superstrength cold rolled weathering steel sheet is manufactured as the following stages:

(1) smelting and controlling the weight percentage of the chemical elements therein as shown in Table 1;

(2) heating and preserving the slab at temperature of 1170~1200° C.;

(3) hot rolling: the finish rolling temperature is more than or equal to Ar3;

(4) coiling: the coiling temperature is 450~550° C.;

(5) pickling;

(6) cold rolling: the cold rolling reduction rate is 50~60%;

(7) continuous annealing: the annealing temperature is 830~880° C. so as to enable the complete austenization, then the steel is cooled rapidly (the cooling speed is more than 100° C./s) in high hydrogen atmosphere (the volume fraction of hydrogen therein is 60%.) so as to attain martensite structure;

(8) skin passing.

Table 1 lists the weight percentage of the chemical elements in the superstrength cold rolled weathering steel sheet in Embodiments 1~7.

TABLE 1

(wt %, the remainders being Fe and other unavoidable impurities)

| No. | C | Mn | Al | Cu | Cr | Ni | Ti | P |
|---|---|---|---|---|---|---|---|---|
| Embodiment 1 | 0.08 | 1.8 | 0.04 | 0.35 | 0.45 | — | 0.030 | 0.01 |
| Embodiment 2 | 0.10 | 1.7 | 0.04 | 0.3 | 0.5 | — | 0.035 | 0.01 |
| Embodiment 3 | 0.14 | 1.4 | 0.03 | 0.25 | 0.5 | — | 0.02 | 0.01 |
| Embodiment 4 | 0.15 | 1.2 | 0.04 | 0.3 | 0.55 | — | 0.015 | 0.01 |
| Embodiment 5 | 0.06 | 2.2 | 0.06 | 0.4 | 0.4 | 0.1 | 0.03 | 0.01 |
| Embodiment 6 | 0.11 | 1.6 | 0.03 | 0.25 | 0.6 | 0.15 | 0.025 | 0.01 |
| Embodiment 7 | 0.16 | 1.0 | 0.02 | 0.20 | 0.45 | 0.2 | 0.03 | 0.01 |

Table 2 lists the technological parameters and mechanical properties in relation to the manufacturing of the superstrength cold rolled weathering steel sheet in Embodiments 1~7

TABLE 2

| No. | Heating and preserving temperature (° C.) | Coiling temperature (° C.) | Reduction rate in cold rolling (%) | Annealing temperature (° C.) | Yield strength (MPa) | Tensile strength (MPa) | Elongation rate (%) | 2a bending |
|---|---|---|---|---|---|---|---|---|
| Embodiment 1A | 1200 | 498 | 50 | 873 | 900 | 1043 | 8.4 | passed |
| Embodiment 1B | 1180 | 457 | 60 | 880 | 1009 | 1117 | 6.7 | passed |
| Embodiment 1C | 1180 | 546 | 60 | 854 | 841 | 1010 | 9.3 | passed |
| Embodiment 1D | 1170 | 509 | 55 | 880 | 931 | 1067 | 7.3 | passed |
| Embodiment 2A | 1190 | 550 | 55 | 859 | 763 | 1053 | 11.1 | passed |
| Embodiment 2B | 1170 | 508 | 60 | 879 | 851 | 1061 | 9.6 | passed |
| Embodiment 2C | 1190 | 454 | 55 | 880 | 859 | 1162 | 9.1 | passed |
| Embodiment 2D | 1200 | 482 | 60 | 862 | 762 | 1020 | 10.2 | passed |
| Embodiment 3A | 1180 | 501 | 60 | 867 | 886 | 1162 | 8.6 | passed |
| Embodiment 3B | 1190 | 465 | 60 | 880 | 970 | 1231 | 8.4 | passed |
| Embodiment 3C | 1180 | 534 | 55 | 871 | 749 | 1100 | 9.6 | passed |
| Embodiment 3D | 1190 | 497 | 55 | 875 | 776 | 1114 | 10.8 | passed |
| Embodiment 4A | 1170 | 495 | 55 | 880 | 903 | 1235 | 8.6 | passed |
| Embodiment 4B | 1170 | 533 | 60 | 867 | 729 | 1154 | 10.3 | passed |
| Embodiment 4C | 1180 | 514 | 55 | 872 | 854 | 1216 | 8.6 | passed |
| Embodiment 4D | 1180 | 475 | 60 | 880 | 960 | 1231 | 8.2 | passed |
| Embodiment 5A | 1190 | 523 | 60 | 878 | 940 | 1140 | 9.3 | passed |
| Embodiment 5B | 1180 | 489 | 60 | 857 | 852 | 1067 | 11 | passed |
| Embodiment 5C | 1190 | 550 | 60 | 865 | 861 | 1073 | 10.7 | passed |
| Embodiment 5D | 1190 | 509 | 55 | 871 | 900 | 1173 | 9.8 | passed |

TABLE 2-continued

| No. | Heating and preserving temperature (° C.) | Coiling temperature (° C.) | Reduction rate in cold rolling (%) | Annealing temperature (° C.) | Yield strength (MPa) | Tensile strength (MPa) | Elongation rate (%) | 2a bending |
|---|---|---|---|---|---|---|---|---|
| Embodiment 6A | 1200 | 497 | 60 | 848 | 825 | 1050 | 11.3 | passed |
| Embodiment 6B | 1180 | 514 | 55 | 873 | 930 | 1211 | 8.9 | passed |
| Embodiment 6C | 1170 | 506 | 55 | 864 | 900 | 1150 | 9.3 | passed |
| Embodiment 6D | 1200 | 550 | 60 | 877 | 951 | 1198 | 9.6 | passed |
| Embodiment 7A | 1200 | 526 | 55 | 880 | 856 | 1209 | 9.5 | passed |
| Embodiment 7B | 1180 | 495 | 60 | 864 | 790 | 1120 | 11.5 | passed |
| Embodiment 7C | 1200 | 487 | 55 | 858 | 807 | 1132 | 10.6 | passed |
| Embodiment 7D | 1180 | 550 | 55 | 877 | 930 | 1220 | 9.4 | passed |

The compositions of the steel in Embodiments 1~7 in Table 2 corresponds to that in Table 1, that is, Embodiments 1A, 1B, 1C, and 1D all use the compositions in Embodiment 1 shown in Table 1.

Seen from Table 2, the superstrength cold rolled weathering steel sheet in the present invention has a yield strength of more than 700 Mpa, up to the maximum of 1009 Mpa; a tensile strength of more than 1000 Mpa, up to the maximum of 1235 Mpa; an elongation rate of more than 6%, up to the maximum of 11.5%; in the meantime, it has passed the 2a bending test. The steel sheet is adapted for manufacturing the parts like automobile structures and container panels with high strength and light weight, and the main forming processes of the finished steel sheets are rolling and simple folding, thereby having a broad application prospects.

It should be noted that the listed above are just some detailed embodiments of the present invention. Obviously, the present invention is limited to the above embodiments, and various modifications may be made with them. If the skilled in the art conducts directly or associates any variations, all of them should fall within the protection scope of the claims.

What is claimed is:

1. A superstrength cold rolled weathering steel sheet, consisting of the following chemical elements, in weight percentage:

C: 0.05~0.16%;
Mn: 1.00~2.20%;
Al: 0.02~0.06%;
Cu: 0.20~0.40%;
Cr: 0.40~0.60%;
Ti: 0.015~0.035%;
P: less than or equal to 0.03%;
Ni: less than or equal to 0.20%; and
the balance being Fe and other unavoidable impurities,
wherein C+Mn/16 is more than 0.19% and less than 0.23%,
wherein the superstrength cold rolled weathering steel sheet has a yield strength of more than 700 MPa and a tensile strength of more than 1000 MPa and wherein the microstructure thereof is martensite, the volume fraction of which is more than 95%.

2. The superstrength cold rolled weathering steel sheet according to claim 1, wherein the weight percentage of the chemical elements thereof are further defined as follows:

C: 0.07~0.15%;
Mn: 1.30~2.00%;
Al: 0.02~0.04%;
Cu: 0.25~0.35%;
P: less than or equal to 0.015%.

3. The superstrength cold rolled weathering steel sheet according to claim 1, wherein the thickness thereof is 0.8~1.5 mm.

4. A container panel manufactured with said superstrength cold rolled weathering steel sheet according to claim 1.

5. An automobile structural plate manufactured with said superstrength cold rolled weathering steel sheet according to claim 1.

6. A method of manufacturing said superstrength cold rolled weathering steel sheet according to claim 1, wherein it comprises the following stages: smelting, heating and preservation, hot rolling, coiling, pickling, cold rolling, continuous annealing, skin passing; wherein, in the continuous annealing process, the annealing temperature is 830~880° C. so as to enable the complete austenization, then the steel is cooled rapidly in an high hydrogen atmosphere so as to attain martensite structure.

7. The method of manufacturing said superstrength cold rolled weathering steel sheet according to claim 6, wherein in the stage of continuous annealing, the volume fraction of hydrogen in the high hydrogen atmosphere is 60%.

8. The method of manufacturing said superstrength cold rolled weathering steel sheet according to claim 6, wherein in the stage of continuous annealing, the cooling speed of the rapid cooling is more than 100° C./s.

9. The method of manufacturing said superstrength cold rolled weathering steel sheet according to claim 6, wherein in the stage of continuous annealing, the annealing temperature is 850~880° C.

10. The method of manufacturing said superstrength cold rolled weathering steel sheet according to claim 6, wherein in the stages of heating and preservation, the slab is heated and preserved at 1170~1200° C.

11. The method of manufacturing said superstrength cold rolled weathering steel sheet according to claim 6, wherein in the stage of hot rolling, the finish rolling temperature is more than or equal to Ar3.

12. The method of manufacturing said superstrength cold rolled weathering steel sheet according to claim 6, wherein in the stage of coiling, the coiling temperature is 450~550° C.

13. The method of manufacturing said superstrength cold rolled weathering steel sheet according to claim 6, wherein in the stage of cold rolling, the reduction rate therein is 50~60%.

* * * * *